United States Patent [19]

Koszyk

[11] Patent Number: 4,540,529

[45] Date of Patent: Sep. 10, 1985

[54] COMPACT PORTABLE HUMIDIFIER

[76] Inventor: Kathleen Koszyk, 10 Meadowood La., Northfield, Ill. 60093

[21] Appl. No.: 709,773

[22] Filed: Mar. 8, 1985

[51] Int. Cl.[3] ..... B01F 3/04

[52] U.S. Cl. ..... 261/91; 261/24

[58] Field of Search ..... 261/91, 80, 121 M, 74, 261/24; 312/31.02; 220/6, 8; 55/373, 374, 378

[56] References Cited

U.S. PATENT DOCUMENTS

| | | | |
|---|---|---|---|
| 3,290,021 | 12/1966 | Blachly et al. | 261/91 X |
| 3,348,821 | 10/1967 | Martin et al. | 261/91 X |
| 3,365,181 | 1/1968 | Schwaneke | 261/91 X |
| 3,376,025 | 4/1968 | Flury | 261/91 X |
| 3,640,464 | 2/1972 | Malczewski | 261/91 X |
| 3,864,437 | 2/1975 | Blaszkowski | 261/91 X |
| 4,018,004 | 4/1977 | Soffer | 261/91 X |

*Primary Examiner*—Richard L. Chiesa
*Attorney, Agent, or Firm*—Cook, Wetzel & Egan, Ltd.

[57] ABSTRACT

A portable electric humidifier uses a flexible, disposable bag as a container for water, to provide a compact, collapsible, and easily portable system. A humidifier head contains a motor and an air humidifying apparatus such as a spinning disk and conical shaft. The head is supported on folding legs. The flexible bag is attached to and hangs beneath the humidifier head. The conical shaft extends downwardly from the spinning disk and draws water from the bag and conveys it to the disk, from which it is dispersed in an air stream into a room. The shaft telescopes, to occupy a minimum vertical distance for storage within the height of the collapsed legs. The flexible bag container is inexpensive and may be discarded after use at one location, prior to packing for further travel. Thus, the humidifier provides overnight humidification for a hotel room or the like, while being conveniently packable for transportation in any small suitcase.

7 Claims, 5 Drawing Figures

COMPACT PORTABLE HUMIDIFIER

The present invention relates to humidifying apparatus, particularly to domestic and portable room humidifying apparatus.

Prior art room humidifiers have not been conveniently portable for use by travellers because they invariably have incorporated a rigid or semirigid reservoir integrally with the humidification system. No disposable container is known for use with room humidifiers. A traveller thus has had to carry either a bulky device, or a very small humidifier which has to be frequently refilled, or do without supplemental air humidification beyond that provided by hotel, motel, ship and railroad accommodations. Lack of adequate humidity can be annoying and unhealthful.

In accordance with the principles of the present invention, a compact and portable humidifier comprises a power head, a flexible, disposable bag connected to the head for holding a sufficient quantity of water for overnight room air humidification, and support legs connected to the humidifier head for supporting same during operation. The bag and legs collapse to a compact form for storage in a traveller's suitcase. The supporting legs in one embodiment are carried outside the bag, pivoted together and being captured at their upper ends in slots in the humidifier head, for sliding movement between erected, inward positions and collapsed outward positions. The legs may have base portions underlying the flexible bag, to help support the bag while the humidifier, filled with water, is being transported within a room. A vertical water pick-up shaft is made to telescope within the bag, or is fixed in length and is removable for convenient storage and set up. The bag is disposable, for easy packing and travel.

Figure 1:
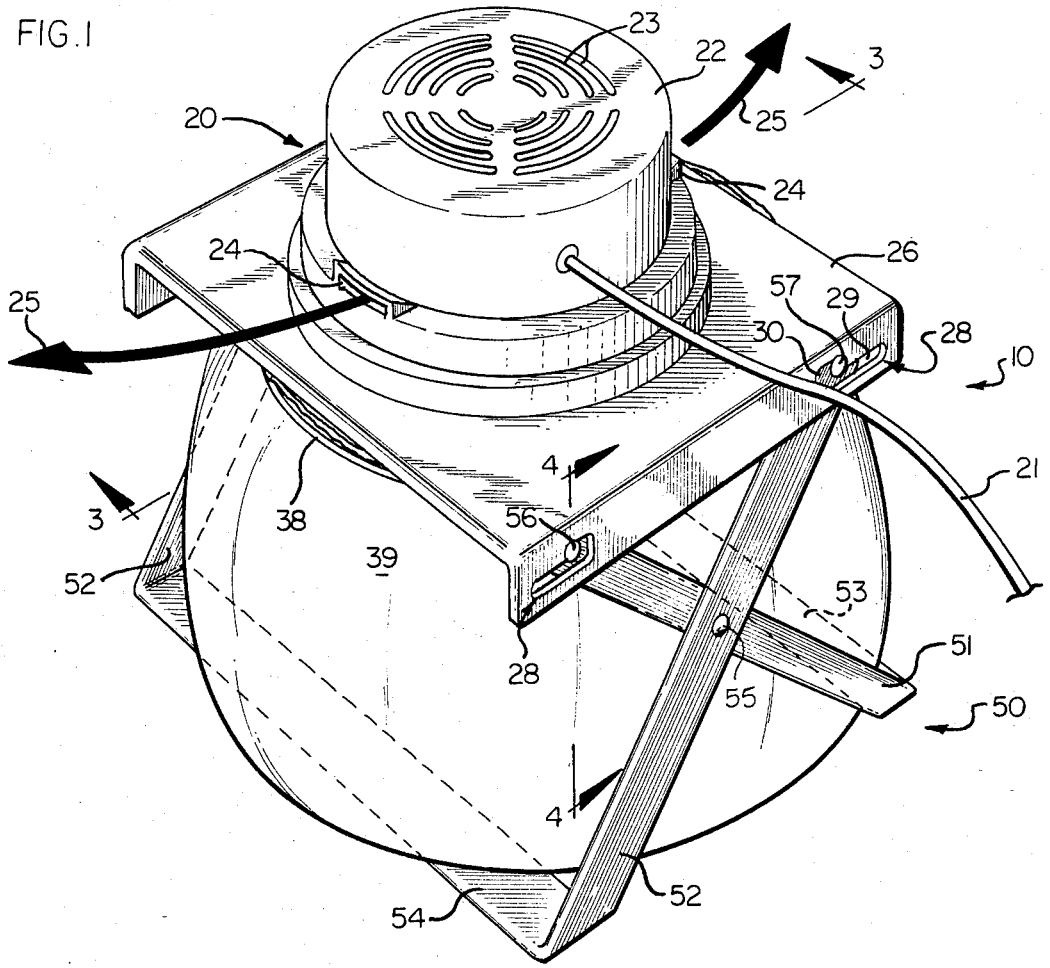
FIG. 1 is a general perspective view of a portable humidifier of the invention, set up for operation.

A portable, compact humidifier in accordance with one embodiment of the present invention is shown at 10 in FIG. 1. A power head 20 is supplied with electric power through a line cord 21 and has a hollow plastic housing 22 for mounting a small, vertical-shaft electric motor M therein. A plurality of vents 23 formed in the top of the housing 22 provide air to cool the motor. The air passes into the head for humidification. Air outlets 24 are provided in the housing 22 for release of the humidified air, depicted by the arrows 25, into the room.

The humidifier head 20 further comprises a top plate 26 which carries the motor housing 22. A water inlet port is provided through the top plate 26, in a position away from the power cord and not shown in the drawings. The top plate 26 terminates at its ends in downturned lips 27, each of which contain a pair of "J"-shaped slots 28. These slots 28 have lower, elongated horizontal portions 29, inward vertical portions 30, and upper catch portions 31, as better shown in FIG. 2.

Figure 3:
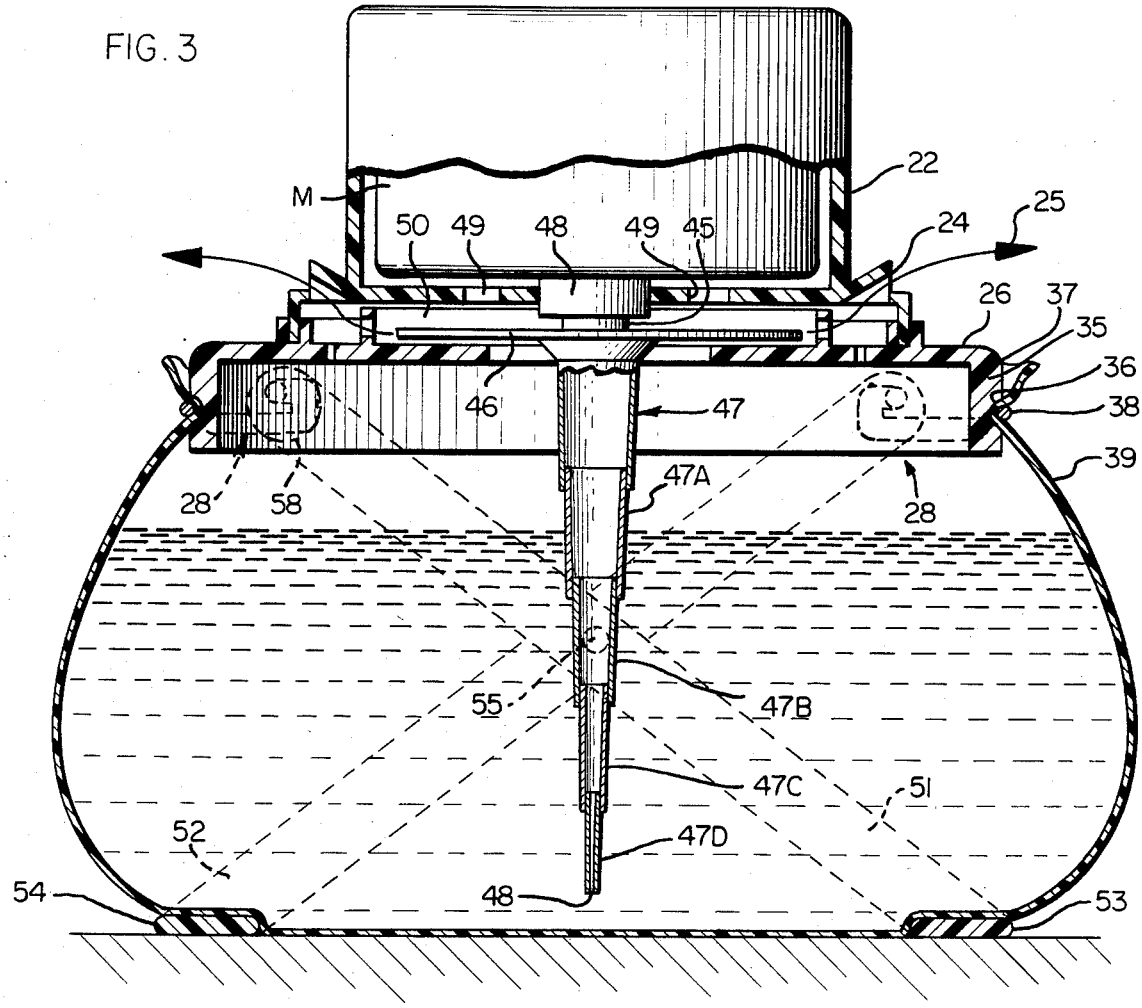
FIG. 3 is a view taken on line 3—3 of FIG. 1, partly in section through the humidifier, and showing the internal components thereof.
Figure 4:
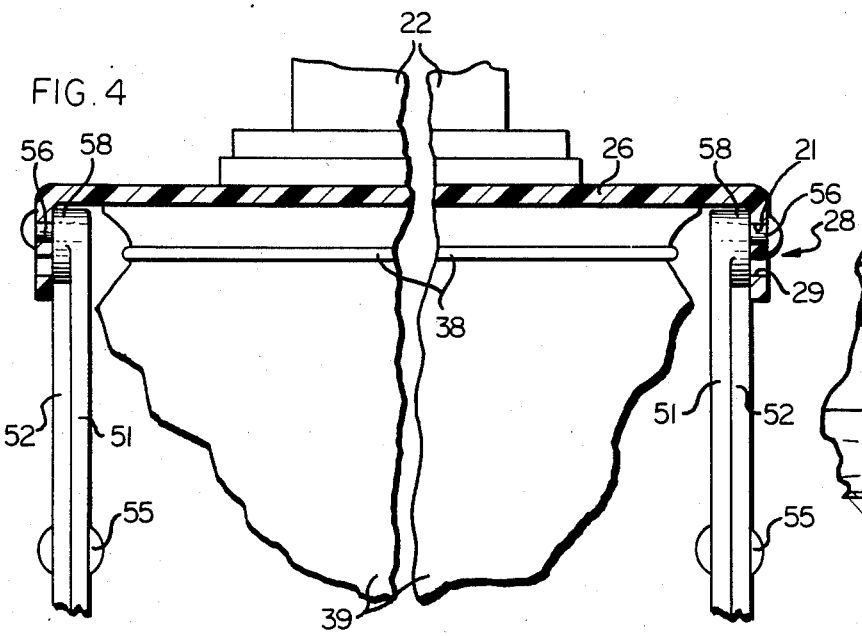
FIG. 4 is a longitudinal sectional view, taken on plane 4—4 of FIG. 1, and partly broken away.

As shown in FIG. 3, a downwardly depending skirt 35 is formed on the undersurface of the top plate 26. An annular recess 36 is formed in an outer surface 37 of the skirt 35. A crimping member 38, which is an elastic band or a spring steel band such as a hose clamp, holds securely a disposable, flexible water reservoir bag 39 suspended downwardly from the skirt 35. The outer surface 37 of the skirt 35 is shown as cylindrical in shape, but it may alternatively be generally rectangular or of other convenient shape, depending on the desired design appearance of the humidifier 10.

The bag 39 is of tough but light and flexible material such as reinforced, waterproofed nylon sheeting, or 4 or 6 mil polyvinyl chloride plastic sheeting. It may be of inexpensive material and configuration and be disposable after use at one location. Disposability avoids the problems of packing a wet container into a suitcase.

A vertically extending shaft 45 of the motor contained within the housing 22 carries integrally therewith a disk 46 which carries on its under surface a downwardly extending water-drawing shaft 47. The motor shaft 45 is journaled in a bearing 48 mounted in the motor housing 22. Air slots 49 exhaust air drawn into the slots 23 in the top of the housing 22 into a water misting chamber 50 which contains the spinning disk 46.

Figure 5:
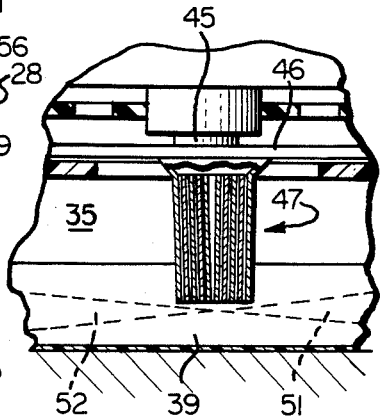
FIG. 5 is a sectional view taken on the plane of FIG. 3 but with the bag, legs, and shaft collapsed.

The water drawing shaft 47 is an inverted cone and, in accordance with one facet of the invention, is formed as a plurality of telescoping sections 47A, 47B, 47C, and 47D. The upper portion of the shaft 47 is carried directly on and in communication with the surface of disk 46, and the lower portions A through D when unsupported fall of their own weight to the position shown in FIG. 3. Inner surfaces of the upper portions engage frictionally with the outer surface of each next lower section in the extended position, to insure that the sections are co-axial and that they spin together. The sections at the same time easily collapse to the position shown in FIG. 5 upon collapsing of the supporting legs, as described below. A lowermost end 48 of the shaft 47 is rounded so as to reduce risk of any puncture to the bag 39.

Alternatively, rather than being telescopic, the shaft 47 can be made as a single member of a proper length, with a releasable press-fitting between an upper portion of the shaft 47 and the disk 46 for co-axial alignment and positive attachment. Such a removable shaft is easily manipulated through the flexible bag 39 if desired, being attached for use prior to filling the bag 39 with water and being detached by pulling it from the press-fit connection upon completion of use. Alternatively, the crimping member 38 can be detached from the skirt 35 and the shaft manipulated directly, particularly where the bag 39 is disposable and is removed for packing.

The power head 20 of the humidifier 10 is supported a selected distance above a table top surface (with the flexible bag 39 supported from and below the head 20) by two pairs of collapsible legs 50, comprising an inward pair of legs 51 and an outward pair 52. In the embodiment shown, the legs of each pair are joined together at their bottoms by longitudinal members 53, 54, which lie directly upon the table top and support and strengthen the lower ends of each pair of legs 51, 52. Each pair of legs 51, 52 is pivoted together at their juncture at a pin 55. Upper ends of the legs 51, 52 carry further pins 56, 57, which are captured in the slots 28 formed in the downturned lips 27 of the top plate 26 of the humidifier at 20. The upper ends of the inner legs 51 are formed with spacer disks 58 which have the thickness of the outer legs 52, to avoid manufacturing complexity while assuring smooth operation of the legs 51 and 52 in their folding and unfolding action.

Figure 2:
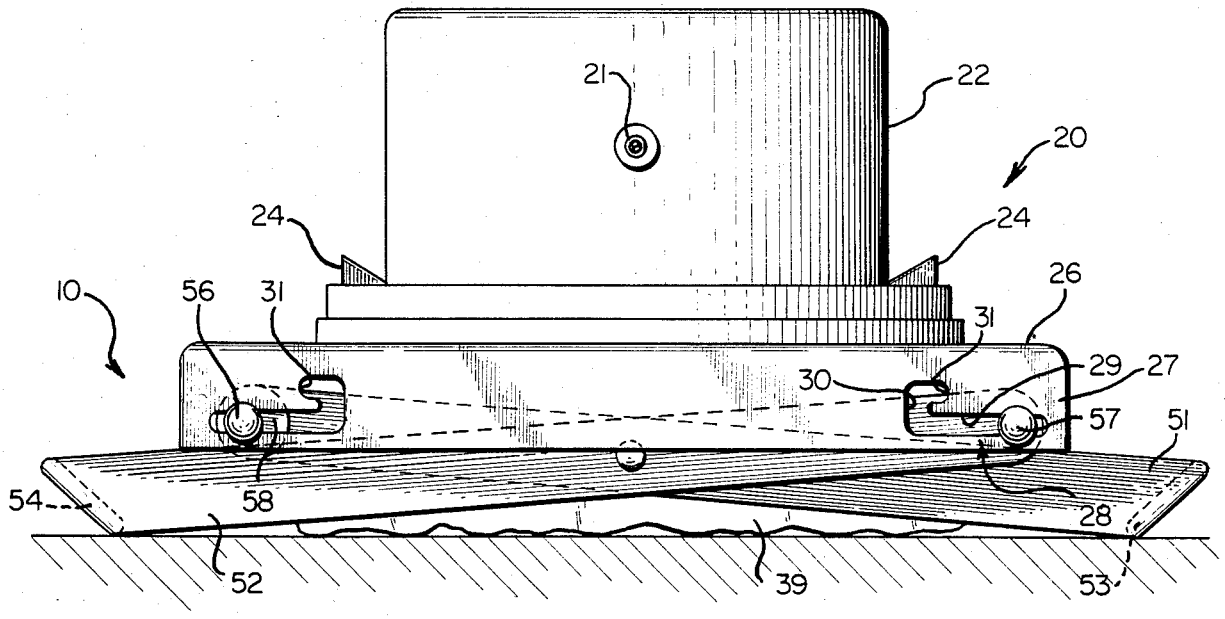
FIG. 2 is an end elevation view of the portable humidifier with its legs, a bag, and the shaft collapsed for packing and transportation.

In use, the humidifier 10 is unpacked from a traveller's suitcase in the configuration shown in FIG. 2. The legs 51 and 52 are unfolded downwardly, with the captured pins 56 and 57 moving inwardly in the lower horizontal slots 29 to the inward edge of the vertical slot 30, and then up and into the capture slots 31. In that position the legs 51, 52 are locked into the fully downward position shown in FIG. 1. The shaft 47 is placed into position, either of its own weight or by manual manipulation, either directly or through the bag 39 if that is in place already. Where the telescoping shaft shown in FIG. 3 is used, it is a good idea to grasp the lowermost section 47D and pull it gently downwardly, to insure that the sections are fully extended and straight. The bag 39 is attached to the skirt 35 if not in place already, by placing its open end around the outer surface 37 and securing the crimping member 38 about it and into the annular notch 36. Then the bag 39 is filled with water through the filling port (not shown) in the top plate 26, and the humidifier 10 is placed on a table top surface for use. The flat base portions 53, 54 of the legs 51, 52 help support the weight of the bag and water during carrying from a sink to the tabletop. Alternatively, the bag 39 of course can be filled by pouring water from another container at the location of use.

When the line cord 21 is plugged into a wall outlet, and any line switch (not shown) is closed, motor shaft 45 spins the disk 46 and the water drawing shaft 47. Air is drawn through the slots 23 and through the motor casing 22 by the centrifugal action of disk 46, forcing air from the misting chamber inlet slots 49 through the outlet apertures 24 in streams 25. Water is drawn from the flexible bag 39 up the interior walls of the shaft 47 and onto the disk 46. Spinning of the disk breaks the water film into fine droplets as they leave the outward edge of the disk 46, where the droplets join the stream or air 25, thus enriching the stream of air 25 with moisture. About five pints of water within the bag 39 will humidify a heated hotel room adequately for a 7 to 9 hour period.

When the humidifier 10 is to be packed for travel, the bag 39 is removed and may be discarded. It can alternatively be emptied either through the filling spout or by detaching the crimping band 38 from the skirt 35 and pouring remaining water from one side of the bag 39, and the bag retained for reuse. The legs 51 and 52 are folded back to their collapsed positions by moving the pins 56 and 57 in the slot members 28, and the shaft 47 is telescopically collapsed or is removed and placed to one side within bag 39.

Various minor modifications to the one embodiment shown and described will readily occur to one having skill in the humidifier design art, without departing from the principles of this invention. The invention is defined and limited only by the scope of the appended claims, and not by any particulars of the single embodiment herein.

I claim as my invention:

1. A portable humidifier for use on a table-top comprising:

a compact humidifier head including means for generating a stream of air and for enriching the water content of said stream of air;

a flexible bag connected to said humidifier head and adapted to hold water in communication with said means for enriching water content of said stream of air; and support legs connected to said humidifier head, said legs being collapsible to a first position to lie immediately below the head and extendible to a second position to support the head a greater, fixed distance above said table-top, whereby the flexible bag holds sufficient water when said legs are in their second position for distribution into a room over a desired time to achieve effective room humidification.

2. The portable humidifier defined in claim 1, wherein the humidifier head carries a sliding joint means and wherein the support legs comprise a pair of elongate members joined together at a pivot axis and wherein each of said members has an upper end captured in said sliding joint means of said humidifier head for allowing folding movement of the legs between said first and second positions.

3. The portable humidifier defined in claim 2, wherein the support legs further comprise "U"-shaped members having base portions extending between opposite ends of the humidifier and beneath the flexible bag.

4. The portable humidifier defined in claim 3, wherein the legs and the base portions have flat cross-sections and wherein the base portions engage and support the flexible bag when said humidifier is lifted from said table top.

5. The portable humidifier defined in claim 1, wherein the means for generating said stream of air and for enriching the water content of said stream comprises a flat disk spun by a motor and a vertical shaft having a conical shape and partly immersed in said water, and wherein the shaft includes a series of telescoping shaft sections.

6. The portable humidifier defined in claim 1, wherein the support legs are connected to the humidifier head outside the flexible bag.

7. The portable humidifier defined in claim 1, wherein the flexible bag is disposable and is adapted to be discarded and replaced with a fresh bag after use.

* * * * *